United States Patent [19]

Hope et al.

[11] 4,379,396

[45] Apr. 12, 1983

[54] OPERATION OF A MULTI-STAND HOT ROLLING MILL

[75] Inventors: Thomas Hope, Doncaster; Ewan C. Hewitt, Sheffield, both of England

[73] Assignee: Davy-Loewy Limited, Sheffield, England

[21] Appl. No.: 178,003

[22] Filed: Aug. 14, 1980

[30] Foreign Application Priority Data

Aug. 14, 1979 [GB] United Kingdom ..... 7928222

[51] Int. Cl.[3] ..... B21B 37/08; B21B 37/10; B21B 45/02

[52] U.S. Cl. ..... 72/13; 72/19; 72/201

[58] Field of Search ..... 72/13, 16, 19, 21, 201

[56] References Cited

U.S. PATENT DOCUMENTS

| | | | |
|---|---|---|---|
| 3,208,253 | 9/1965 | Roberts | 72/21 |
| 3,514,984 | 6/1970 | Cook | 72/201 X |
| 3,628,358 | 12/1971 | Fapiano et al. | 72/19 X |
| 3,779,054 | 12/1973 | Greenberger | 72/13 |
| 3,812,693 | 5/1974 | Kamagawa et al. | 72/13 |

*Primary Examiner*—Ervin M. Combs

*Attorney, Agent, or Firm*—Schwartz & Weinrieb

[57] ABSTRACT

A multi-stand rolling mill is operated so that strip of suitable shape and metallurgical properties is produced at a faster speed than possible heretofore by threading the mill at a relatively slow speed and adjusting the rolling loads on the stands to give the required output gauge and rolling temperature at the last stand, thereafter the mill is accelerated and curtains of liquid coolant are applied to the workpiece at one or more interstand locations to ensure that the rolling loads remain substantially the same as when threading and the rolling temperature of the last stand remains substantially constant.

9 Claims, 8 Drawing Figures

925°
900°
875°
TEMP°C
12
11
10
9
8
FINISHING SPEED (M/S)
FLOW RATE
0
10
20
30
40
50
TIME (SECS)

OPERATION OF A MULTI-STAND HOT ROLLING MILL

FIELD OF THE INVENTION

This invention relates to a method of operating a multi-stand rolling mill for rolling hot metal strip.

BACKGROUND OF THE INVENTION

In the manufacture of metal strip it is usual to reduce a hot metal workpiece down to strip by passing it, while hot, through the stands of a rolling mill. There are usually at least six stands arranged in tandem and the hot workpiece is progressively reduced in thickness as it is passed through the stands. To ensure that the strip, assuming it to be of steel, has the required metallurgical, properties, it is necessary for the temperature of the strip as it passes through the last stand, to be of the order of 900° C. In a conventional hot strip mill with a delay table between the roughing and finishing mills there is a considerable temperature differential between head and tail ends of the workpiece as it enters the first stand of the finishing train and care has to be taken to ensure that the temperature of the strip along its length is at or close to the required temperature as the strip passes through the last stand.

Furthermore, the mill has to be operated at a relatively slower speed, known as the threading speed, as the head of the workpiece passes through the stands and is attached to a coiler located downstream of the last stand, and thereafter the speed of the mill is increased to its rolling speed. Some mills are accelerated at a constant rate as the strip is passed therethrough, while others are accelerated in a succession of bursts each followed by a period of constant speed. In both methods, the average acceleration rate may be of the order of 0.06 $m/s^2$ for a mill having six stands. Attempts have been made to increase this acceleration rate in order to increase the throughput of the mill but these attempts have so far met with little success because, as the speed is increased, the temperature of the strip at the last stand in the train rises and, if the speed increase is too great, the temperature rises above an acceptable level.

An effect of the temperature differential referred to above is that the rolling loads on the stands increase as the strip is passed through the mill. This variation in rolling load is not equal on each of the stands and consequently the relationship between the rolling loads on the various stands which is set during threading, is not maintained as the strip is accelerated through the mill. This has an undesirable effect on the shape of the strip produced in the mill and particularly strip produced from the tail end of the workpiece may have a shape which is unacceptable to the user.

It is known to provide Vee jet water sprays from nozzles located between the first two or three stands in the mill for the purpose of suppressing the growth of scale on the surface of the workpiece. These sprays are known as "scrubber sprays". Such sprays can only apply a uniform supply of water to the surface of the strip to cool it uniformly if (1) all the jets are correctly set, (2) all the jets are functioning correctly, and (3) the strip is positioned at a preset distance from the spray nozzles. Conditions (1) and (2) are seldom achieved for more than a short time after each maintenance period and the third condition can never be met in practice because the position of the strip relative to the nozzles is continuously changing due to the effect of loopers which are positioned between the stands. The loopers raise and lower the level of the strip in response to the tension in the strip and this is continuously changing. These known scrubber sprays have not resulted in uniform cooling of the strip material and some of the strip produced with mills having scrubber sprays is unacceptable because of striping of the strip with non-uniform temperature zones.

It is known to use these scrubber sprays and possibly further sprays located between the later stands in the mill to increase the acceleration rate by progressively switching them on as the mill speed increases but this can make the normal increase in rolling load greater with further harmful effects on strip quality.

OBJECT OF THE INVENTION

It is an object of the present invention to operate a multi-stand hot rolling mill in a manner in which higher operating speeds can be obtained than heretofore and the resulting strip has both acceptable metallurgical properties and shape.

SUMMARY OF THE INVENTION

According to the invention, in a method of operating a multi-stand hot rolling mill to roll metal strip, the head end of a hot metal workpiece is threaded at a relatively slower speed through the stands of the rolling mill and the rolling load and speed at each stand is set to ensure that the required output gauge and shape at the last stand is obtained and that the rolling temperature at the last stand is at or close to a predetermined level, and thereafter the speed of rolling is increased and the remainder of the workpiece is rolled through the stands to form strip and wherein, during rolling of said remainder of the workpiece, a curtain of liquid coolant is applied across the width of the workpiece at one or more interstand locations to cool it such that the rolling temperature at the last stand remains at or close to said predetermined level and the rolling load at each stand remains substantially equal to that set up during threading.

By ensuring that the rolling load at each stand remains substantially equal to that set up at threading, the strip rolled in the mill has the predetermined shape along its entire length. Furthermore, by ensuring that the rolling temperature at the last stand remains substantially uniform throughout the length of the strip, the required metallurgical properties of the strip are obtained.

A curtain of liquid coolant may be applied to the upper and lower surfaces at each of the interstand spaces but satisfactory results are sometimes obtained when a curtain of liquid coolant is applied at only some of the interstand spaces.

Apparatus for producing water curtains are disclosed in our co-pending U.K. patent application No. 4932/77 and pending European patent application No. 79302407.6.

The flow of water to the strip (both upper and lower surfaces) at each interstand space may be controlled in response to the rolling load on the next succeeding stand or by the temperature at the entry to the next succeeding stand.

BRIEF DESCRIPTION OF THE DRAWINGS

In order that the invention may be more readily understood it will now be described, by way of example only, with reference to the accompanying drawings, in which:-

DETAILED DESCRIPTION OF THE PREFERRED EMBODIMENT

Figure 1:
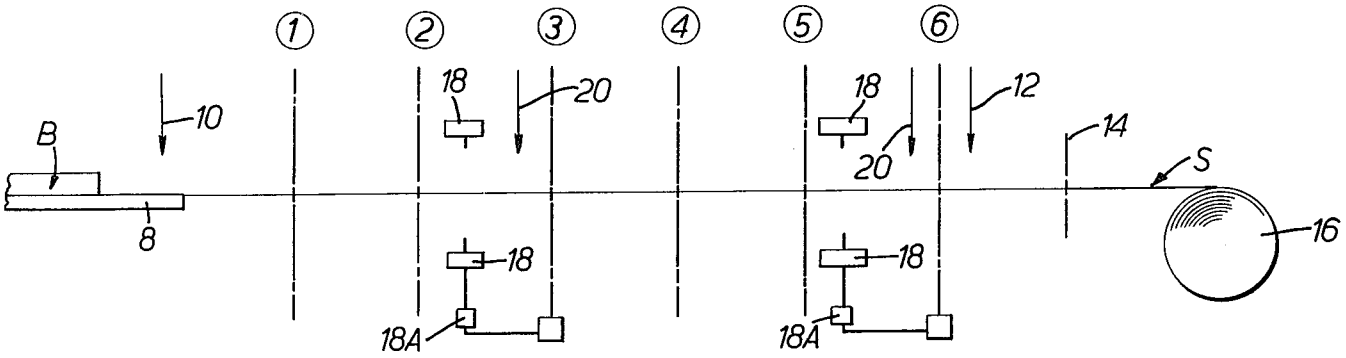
FIG. 1 is a diagrammatic side elevation of a multi-stand hot rolling mill.

Referring to FIG. 1, a rolling mill for hot rolling a slab B into metal strip S comprises six mill stands 1–6 respectively arranged in tandem. Stand 1 is preceded by a run-in table 8 on which the hot slab resides before it is passed into the mill. A pyrometer 10 for measuring the ingoing temperature of the slab is positioned above the run-in table. A second pyrometer 12 for measuring the temperature of the strip as it leaves the last stand 6 is located downstream but close to the last stand. Also located downstream of the last stand 6 and the pyrometer 12 are a pair of pinch rolls 14 for guiding the strip on to a coiler 16.

Means for applying a curtain of cooling water to the upper and lower surfaces of the strip is located in at least one of the interstand spaces. In the example shown in FIG. 1, headers 18 are positioned above and below the strip between stands 2 and 3 and between stands 5 and 6. These headers produce a coherent curtain of water extending across the full width of the strip. The flow rate of water from each header is adjustable and the control of the water flow is by way of a control valve 18A operated in response to the rolling load of the next mill stand which is downstream of the headers. In other words, the flow of water between stands 2 and 3 is controlled in response to the rolling load on stand 3 and that between stands 5 and 6 is controlled in response to the rolling load on stand 6. A pyrometer 20 can also serve to control the flow of water from the headers at each location. Headers may be positioned upstream of the first stand.

Figure 3:
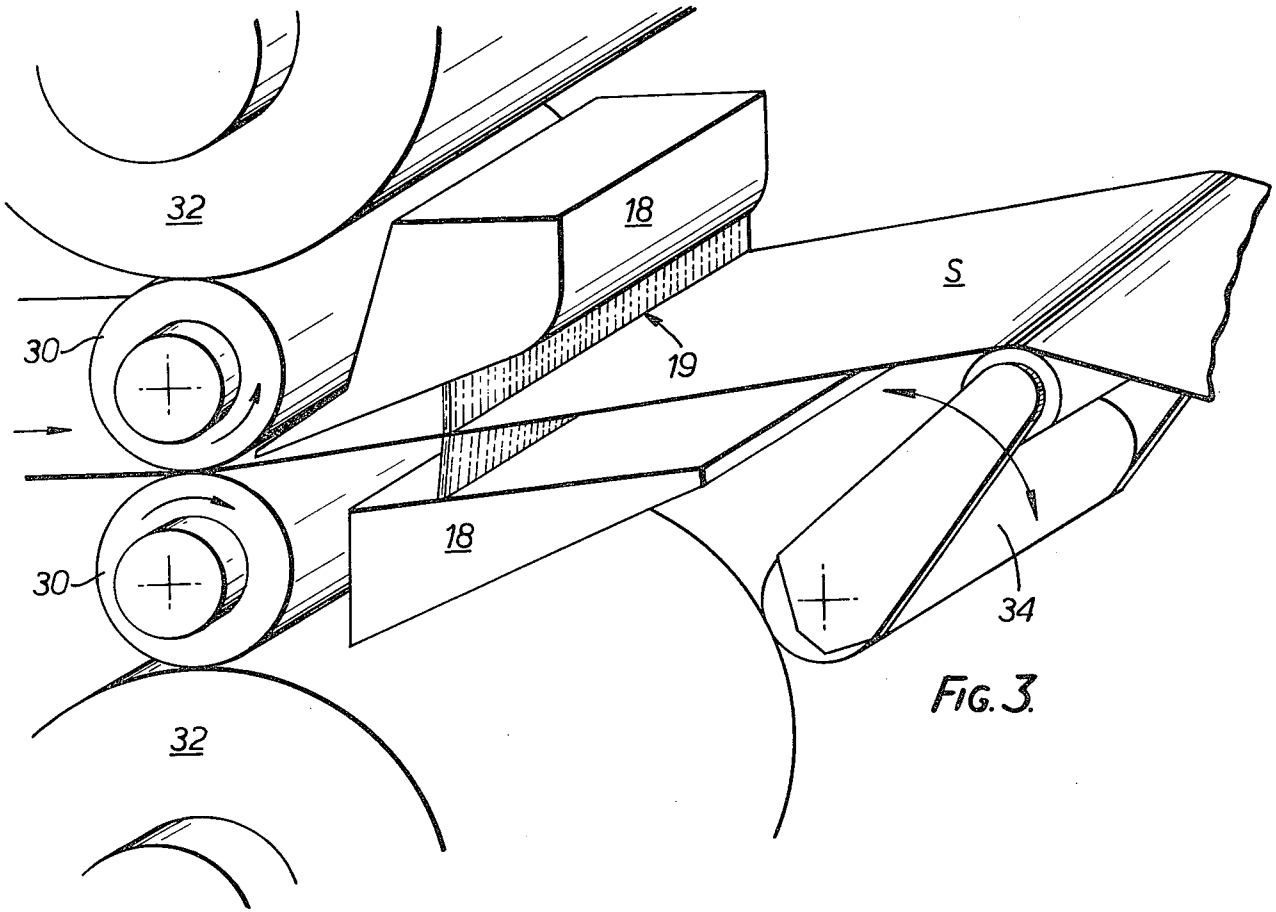
FIG. 3 is a diagrammatic perspective view of one stand of the rolling mill of FIG. 1, and FIGS. 4*a*–4*e* are graphs of various parameters of the rolling mill.

Referring to FIG. 3, a rolling mill stand comprises a pair of work rolls 30 each having a back-up roll 32. The workpiece passes between the work rolls. Between the mill stand and the next stand downstream (not shown) there is a looper 34 for raising and lowering the workpiece to take into account variations in the tension of the workpiece. Also between the stands are upper and lower headers 18 for producing upper and lower coherent curtains of cooling water 19. These curtains impinge upon the upper and lower surfaces respectively of the workpiece and extend substantially normal to the direction of movement of the workpiece.

The mill is operated as follows:-

The slab B brought from a furnace (not shown) resides on the run-in table 8. The temperature of the head end of the slab is measured by the pyrometer 10. Depending upon the type of material, the input temperature, and the required gauge after the last stand, the reduction on each mill stand is then chosen so that the output gauge is correct and the rolling temperature at the last stand is at the correct value. The head end of the slab is then threaded through the stands, between the pinch rolls 14 and threaded into the coiler 16.

Figure 2:
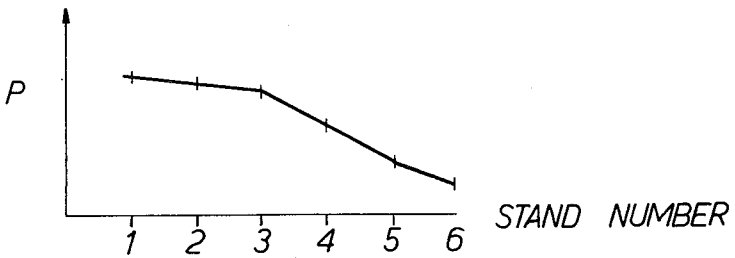
FIG. 2 shows a desired pattern of the rolling loads on each stand in a particular multi-stand configuration.

FIG. 2 shows one kind of desired pattern between the rolling loads on each of the stands of a particular mill configuration for rolling strip of a particular width. It can be seen that the desired rolling load on stands 4, 5 and 6 is progressively reduced from that on stands 1, 2 and 3. It has been found from experience that such a relationship of the rolling loads in a six stand mill produces satisfactorily shaped strip.

Once the mill has been threaded, the operating speed of all the stands is increased so that the time for rolling the slab is reduced. In the absence of cooling water, the temperature of the strip would increase as it passes through the mill due to the increase in speed of the strip and the work done on the strip in reducing its thickness, but the tail end of the slab has cooled considerably while it is on the run-in table and so the actual temperature of the strip at each stand is very difficult to predict.

Figures 4A, 4B, 4C, 4D, 4E:
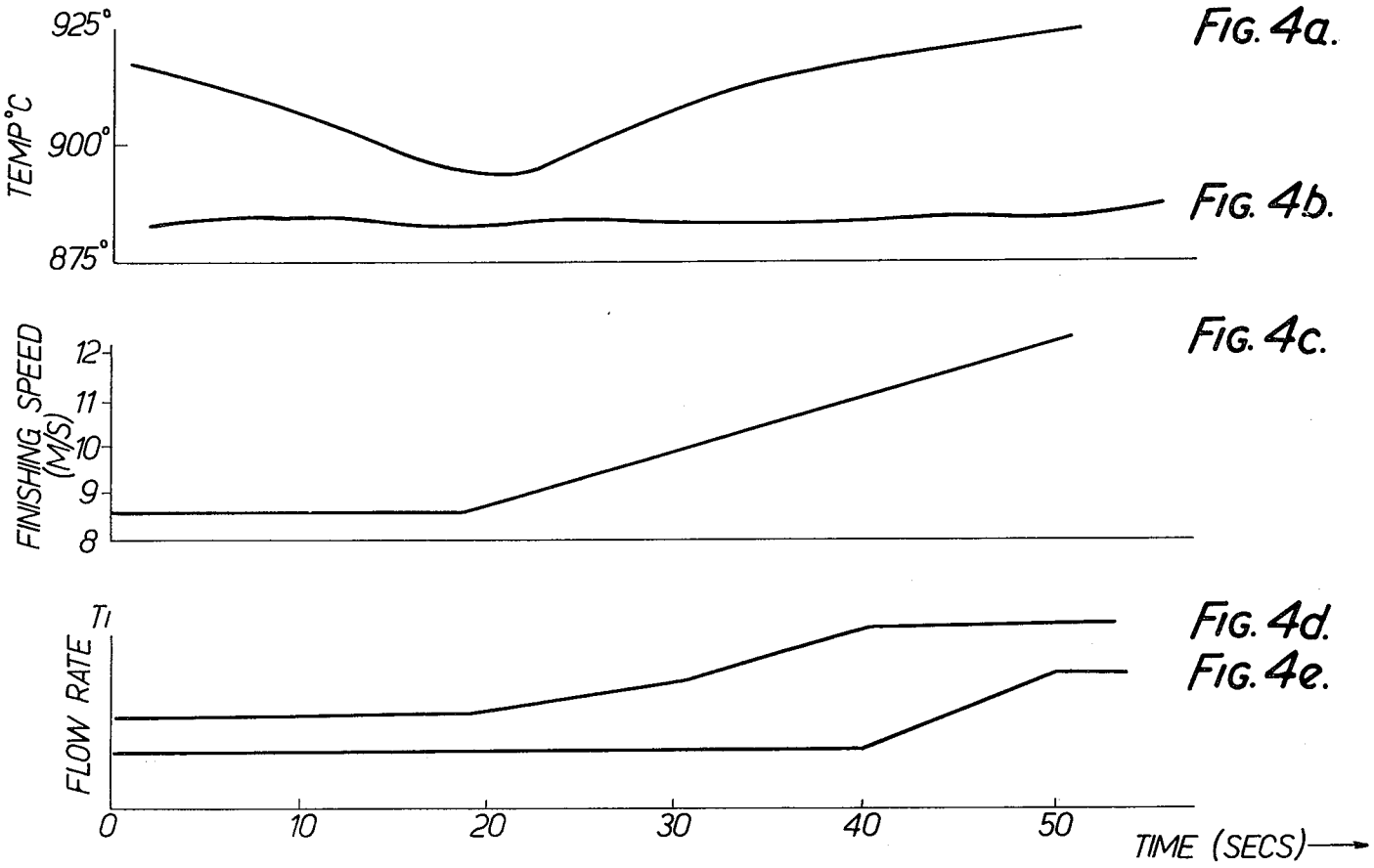

FIG. 4*a* shows a graph of the finishing temperature (°C.) of the strip in the absence of water cooling and FIG. 4*c* shows the speed of rolling (M/S) of the last stand of the mill.

It can be seen that, for the first seventeen seconds or so, as the workpiece is being threaded at a relatively lower speed, the finishing temperature is falling but, as soon as the mill is accelerated as indicated by the straight line part of FIG. 4*c*, the finishing temperature rises significantly above 900° C.

In practice, the rolling load at each stand would change and the pattern of the rolling loads would be considerably different from that at threading, as shown in FIG. 2. This may lead to the strip having an unsatisfactory shape when it leaves the mill.

By operating the control valves on the headers 18, curtains of water are applied to the strip at one or more interstand locations. The water curtains are applied to the strip as the rolling speed is increased and, as shown in FIG. 4*b*, the finishing temperature of the last stand is kept substantially constant at just below 900° C. The rate of water flow from each header is controlled so as to be responsive to the rolling load on the next mill stand downstream from the header. In a control means, the actual value of the rolling load is compared with the value of the rolling load as chosen for the stand when threading the mill and, if there is any change in the actual rolling load, then this produces an error signal which is used to control the flow rate of the water to the curtain in the sense to reduce the error signal substantially to zero.

The headers at each location may be controlled independently of the header at other locations, but FIGS. 4*d* and 4*e* show how the cooling liquid may be applied progressively along the mill stands.

FIG. 4*d* shows the flow rate of the curtains (upper and lower) between stands 1 and 2 of a six stand mill. The flow rate is increased as the finishing speed increases until maximum flow rate $Q_l$ is achieved. As the rolling temperature of the last stand continues to rise, the flow to the curtains between stands 2 and 3 is increased, as shown in FIG. 4*e*, to its maximum value. This may be sufficient to keep the rolling temperature of the last stand at around the required value but, if not, water is supplied to the headers of curtains positioned between stands 3 and 4 and so on until headers between each of the stands are supplied with coolant.

The supply of curtains of liquid coolant may be reversed to that just described. Water may first be supplied in the form of curtains between the last two stands of the mill. When the water flow is at a maximum, and if further cooling is required, then water is supplied in the form of curtains at the preceding interstand location.

In the arrangement described, threading takes place in the absence of curtains of liquid coolant but, if some coolant is applied in the form of curtains to the workpiece during threading, then a slightly faster threading speed can be obtained.

To compensate for any increase in the thermal crown of the rolls which takes place during rolling, the rolling load on each stand may be permitted to increase progressively by a small amount during rolling.

By controlling the temperature of the strip by means of the applied water cooling, the rolling load at each of the stands remains substantially the same as that at threading and the rolled strip has a satisfactory shape throughout its length. Furthermore, by ensuring that the rolling temperature at the last stand remains constant, the strip has the required metallurgical properties along its length.

By operating a hot rolling mill in accordance with the invention, satisfactory strip can be obtained with a considerable increase in rolling speed, thereby improving the throughput and the operating efficiency of the mill.

By choosing to thread the mill with some curtains of water applied even to the front end of the strip, it will be possible, with some gauges and widths of strip, to thread the mill faster than would have been possible without the application of such water. Thereafter the water flows are increased progressively as already described.

It is well known that the work and/or back-up rolls of the finishing mill increase in temperature during the rolling of a workpiece and then reduce in temperature while awaiting the next workpiece to be threaded. This effect can change the thermal crowns of the rolls and thereby modify the transverse gauge variation or crown in the strip for a given rolling load. It follows therefore that, if thermal growth in the rolls occuring during the rolling of a workpiece reaches significant proportions, it will be necessary to counteract the resultant decrease in strip crown by so modifying the cooling provided by the water curtains as to allow an increase in rolling load during the rolling of the workpiece. This in turn increases the bending of the roll stock by an amount which compensates for the increase in thermal crowns. The inclusion of a mathematical model within the control system which achieves this aim is also within the scope of this invention.

The curtains of liquid coolant also serve to suppress the formation of scale on the surface of the strip and also reduce the amount of oxide pollution of the atmosphere which occurs in a conventional rolling stand.

Obviously, many modifications and variations of the present invention are possible in light of the above teachings. It is therefore to be understood that within the scope of the appended claims, the present invention may be practiced otherwise than as specifically described herein.

We claim:

1. A method of operating a multi-stand hot rolling mill for rolling metal strip, comprising the steps of:

rotating the rolls of the stands of said rolling mill at a relatively slow rate of speed so as to thread the head end of a hot metal workpiece through said rolling mill stands;

determining and adjusting the rolling load at each of said stands during said threading operation so as to obtain the required desired output gauge of said strip and the required desired shape of said strip at the last stand, and to predetermine the rolling temperature at said last stand;

rotating said rolls of said stands of said rolling mill at a speed faster than that of said threading speed for rolling said workpiece through said mill;

providing coolant means for said workpiece at one or more interstand locations for cooling said workpiece during said rolling operation;

determining the rolling load at each of the next stands downstream from said one or more interstand coolant application locations during said higher-speed rolling operation and comparing said high-speed rolling operation load values with said low-speed threading operation load values; and controlling the quantity of coolant applied to said workpiece at each of said coolant interstand locations as a function of, and in response to, the differential between said high-speed and low-speed load values such that said rolling load at each of said downstream stands during said rolling operation remains substantially the same as said rolling load at each of said stands as determined during said threading operation, and the rolling temperature at said last stand remains substantially at said predetermined temperature level.

2. A method as claimed in claim 1, in which, at each interstand location where coolant is applied, a curtain of liquid coolant is applied to the upper and lower surfaces of the workpiece.

3. A method as claimed in claim 2, in which a curtain of liquid coolant is applied to the workpiece between each pair of adjacent stands.

4. A method as claimed in claim 1, 2 or 3, in which the flow rate of the liquid coolant applied at each curtain is adjustable and is dependent upon the rolling load of the next stand downstream of the curtain.

5. A method as claimed in claim 4, in which the rolling load of said next stand is compared continuously during rolling with the rolling load at threading to produce a difference signal and said signal is employed to control the flow of liquid coolant to the curtain immediately upstream of the stand in the sense to reduce the difference signal substantially to zero.

6. A method as claimed in claim 2, in which curtains of liquid coolant are first applied to the workpiece between the first and second stands and, when the flow rate to the curtains is at a maximum value, curtains of liquid coolant are applied to the workpiece between the second and third stands.

7. A method as claimed in claim 2, in which curtains of liquid coolant are first applied to the workpiece between the last two stands and, when the flow rate to the curtains is at a maximum value, curtains of liquid coolant are applied to the workpiece at the preceding interstand location.

8. A method as claimed in claim 1, in which curtains of liquid coolant at low flow rates are applied at some or all of the interstand locations as the head end of the workpiece is threaded through the stands.

9. A method as claimed in claim 1, in which the rolling load at each stand is allowed to increase progressively as the workpiece is rolled to an extent such that any increase in thermal crown in the mill rolls is substantially compensated for.

* * * * *